US007464423B2

(12) United States Patent
Goodwin et al.

(10) Patent No.: US 7,464,423 B2
(45) Date of Patent: Dec. 16, 2008

(54) CONVERTIBLE NURSING BAG

(76) Inventors: Patricia Goodwin, 161 W. 61 St., New York, NY (US) 10023; Markus Peters, 161 W. 61 St., New York, NY (US) 10023

( * ) Notice: Subject to any disclaimer, the term of this patent is extended or adjusted under 35 U.S.C. 154(b) by 0 days.

(21) Appl. No.: 11/243,108

(22) Filed: Oct. 4, 2005

(65) Prior Publication Data

US 2006/0179575 A1 Aug. 17, 2006

Related U.S. Application Data

(60) Provisional application No. 60/651,610, filed on Feb. 11, 2005.

(51) Int. Cl.
*A47G 9/00* (2006.01)

(52) U.S. Cl. ..... 5/655; 640/652

(58) Field of Classification Search ..... 5/640, 5/652, 655, 657, 728, 730
See application file for complete search history.

(56) References Cited

U.S. PATENT DOCUMENTS

| | | | | |
|---|---|---|---|---|
| 4,733,836 | A * | 3/1988 | Barnes | 248/106 |
| 5,216,772 | A * | 6/1993 | Clute | 5/655 |
| 5,333,769 | A * | 8/1994 | Skroski | 224/158 |
| 5,396,674 | A * | 3/1995 | Bolds | 5/633 |
| 6,061,854 | A * | 5/2000 | Crowley | 5/655 |
| 6,189,169 | B1 * | 2/2001 | Marcotte | 5/655 |
| 6,564,408 | B2 * | 5/2003 | Van Vuuren | 5/655 |

* cited by examiner

*Primary Examiner*—Patricia Engle
*Assistant Examiner*—Fredrick Conley
(74) *Attorney, Agent, or Firm*—Fox Rothschild LLP; Gerard P. Norton; Mord Michael Lewis

(57) ABSTRACT

A nursing bag, which has a padded nursing surface that can gently support an infant, a cavity into which baby-care products may be placed, and optionally a stiffening system in the cavity that provides rigidity when the nursing surface is under the weight of an infant. A nursing cover may optionally cover the nursing surface when the nursing surface is not being used as a nursing platform.

23 Claims, 19 Drawing Sheets

CONVERTIBLE NURSING BAG

CROSS-REFERENCE TO RELATED APPLICATIONS

This application claims the benefit of U.S. Provisional Application No. 60/651,610, filed Feb. 11, 2005, which is incorporated herein by reference.

FIELD OF THE INVENTION

The present invention relates generally to baby-care products, and more particularly to a handbag that provides the functionality of a nursing pillow.

BACKGROUND OF THE INVENTION

A nursing mother needs to use a pillow to support her baby while feeding. Due to their size, nursing pillows are often quite cumbersome and are not easily transportable. Many infants feed every three hours, while others demand to be fed even more frequently. This essentially requires a mother to have a nursing pillow on hand at all times, which can be quite a burden considering all of the other accoutrements a mother needs to carry. As a result, many mothers often find themselves without a nursing pillow when their infant is demanding to be fed, and must therefore either do without, or attempt to use some other object, ill-suited to the task, as a substitute nursing pillow.

It is therefore desirable to provide a bag that can be used to carry baby-care products and other items, but which may also double as a nursing pillow.

SUMMARY OF THE INVENTION

The present invention fills the foregoing need by providing a handbag that provides the functionality of a nursing pillow. In one embodiment, a nursing bag is defines a cavity into which items, such as baby-care products, may be placed. In certain embodiments, the nursing bag may be substantially u-shaped. In other embodiments, the external appearance of the nursing bag may be similar to "hobo"-type handbags. A nursing side of the nursing bag is wide enough to provide a nursing platform. In one embodiment, the nursing side is about 16 to about 26 inches wide. Padding is disposed on the nursing side, which provides a soft, yielding surface for a nursing infant. In one embodiment, the padding is removably disposed on the nursing side. In one aspect, a stiffening system is disposed within the cavity of the bag to provide structural support to maintain the shape of the cavity when the nursing side is under the weight of an infant. In one embodiment, the stiffening system may be removed if not needed. In another embodiment, the stiffening system divides the cavity into two or more compartments. The stiffening system may support the weight of an infant of approximately 20 pounds when nursing. In another aspect, a nursing cover removably covers the padding. This nursing cover may contain a pocket on its internal surface. In another embodiment, the nursing bag has a strap that can be attached and detached around the waist of a nursing parent. The strap may have cinches to tighten or loosen the strap.

DETAILED DESCRIPTION OF THE INVENTION

Before describing several exemplary embodiments of the invention, it is to be understood that the invention is not limited to the details of construction set forth in the following description and drawings. The invention is capable of other embodiments, and of being carried out in various ways.

The present invention relates to a nursing bag with a padded nursing surface that can gently support an infant, a cavity into which baby-care products may be placed, and optionally a stiffening system in the cavity that provides rigidity when the nursing surface is under the weight of an infant. In one aspect of the present invention a nursing cover may optionally cover the nursing surface when the nursing surface is not being used as a nursing platform.

Figure 1:
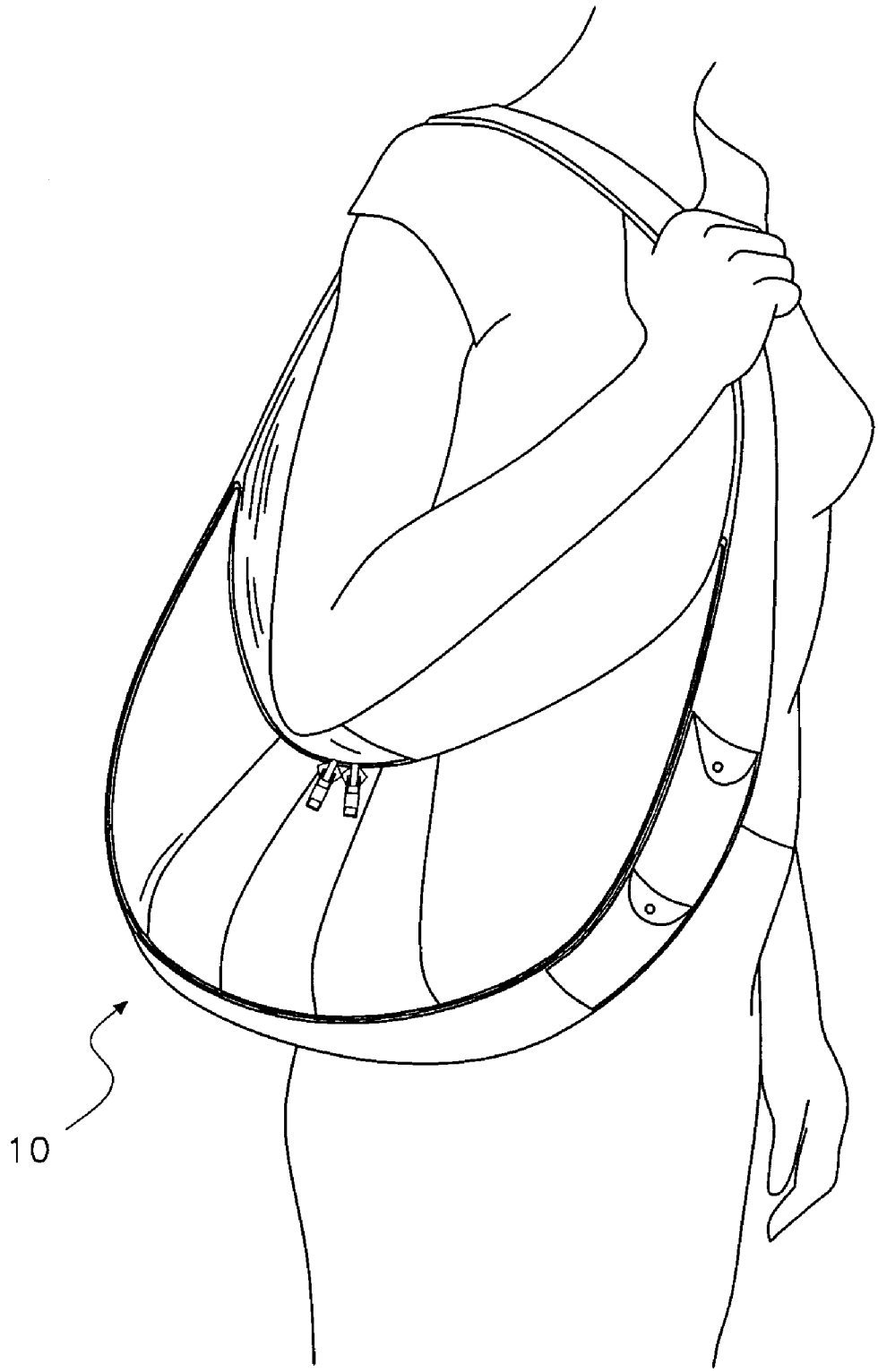
FIG. 1 is a perspective view of a first embodiment nursing bag configured as a handbag.
Figure 2:
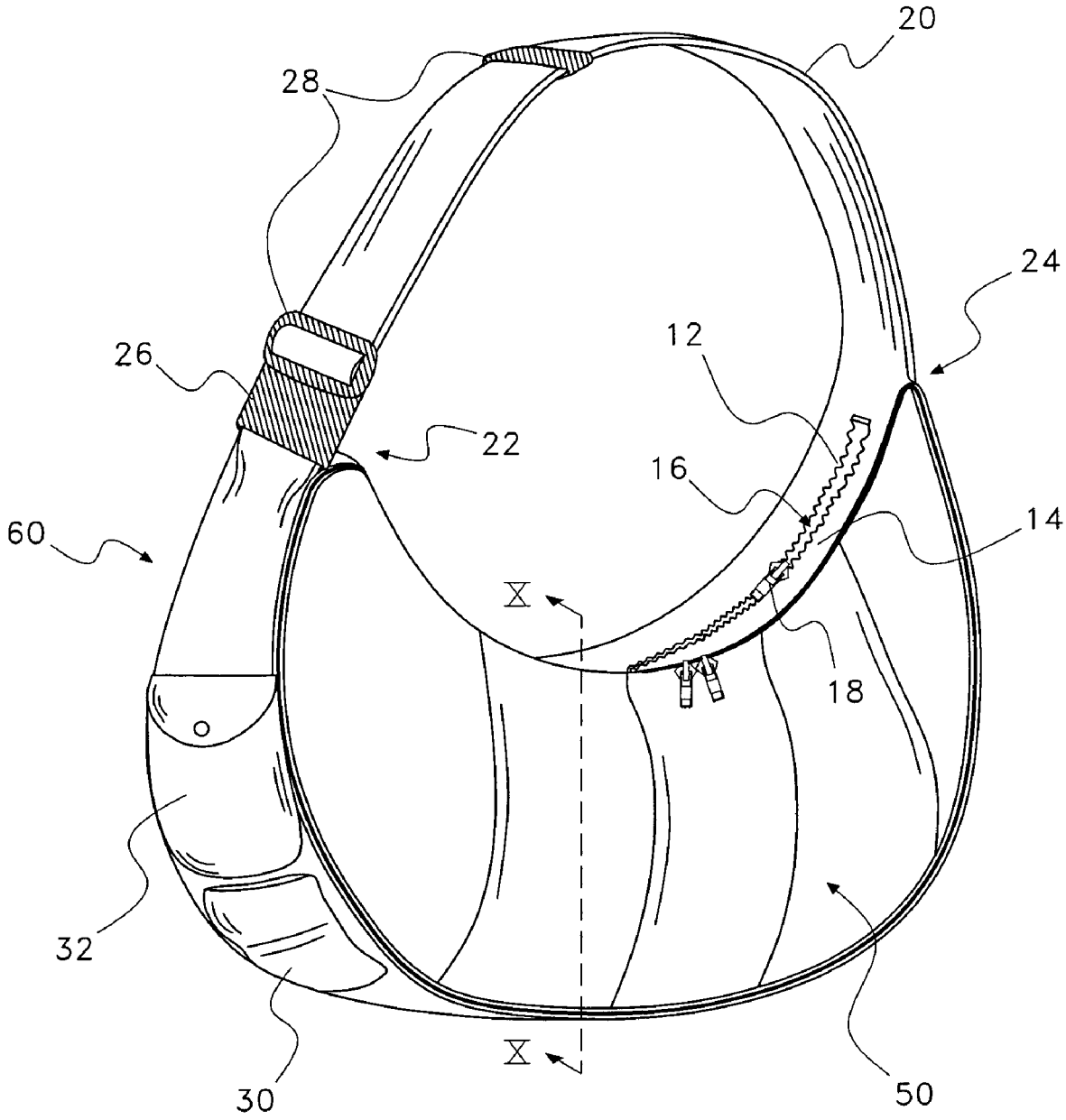
FIG. 2 is another perspective view of the nursing bag depicted in FIG. 1.
Figure 3:
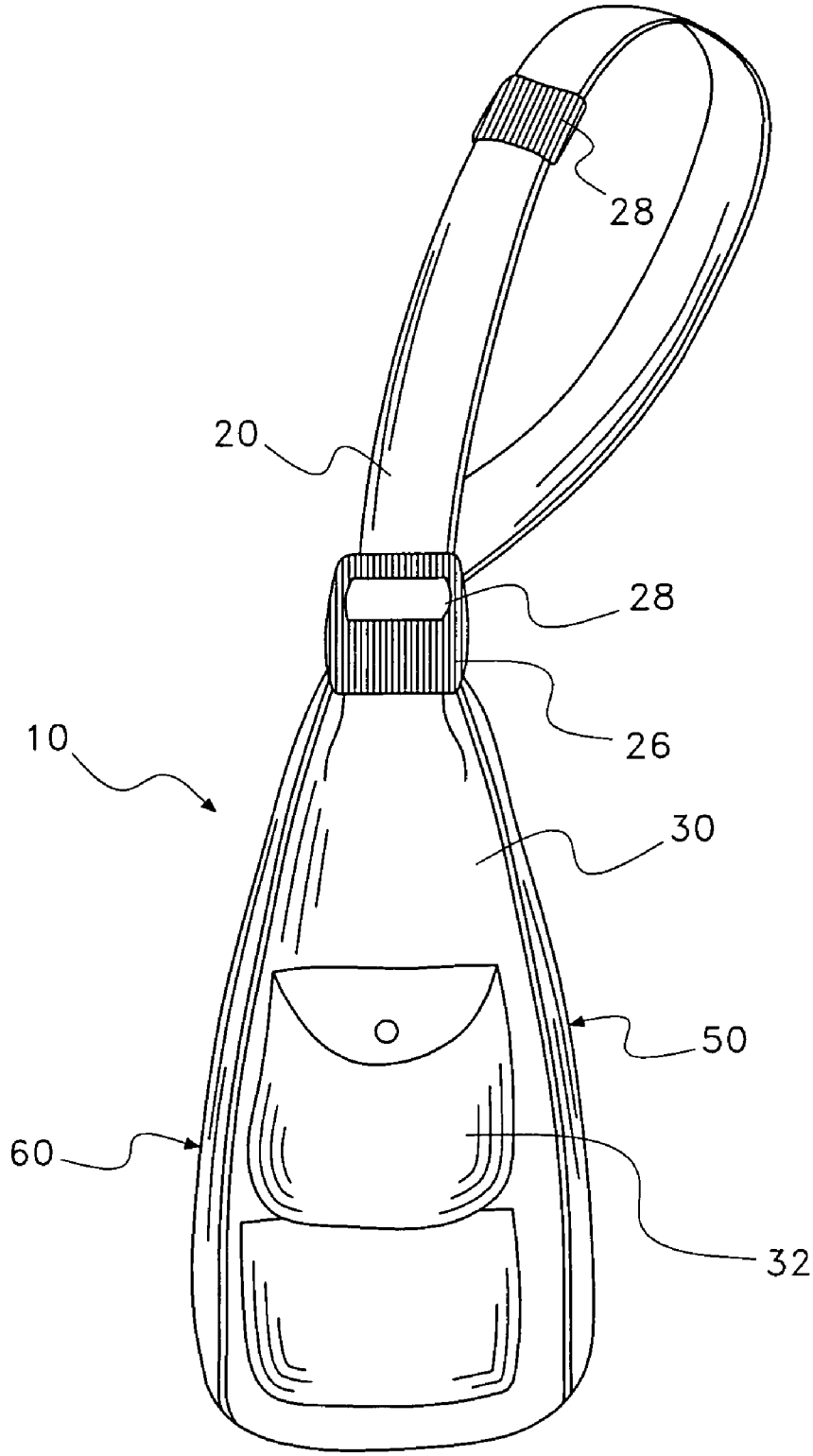
FIG. 3 is a side view of the nursing bag depicted in FIG. 1.

A convertible nursing bag 10 in a first configuration as a "hobo bag" handbag is shown in FIGS. 1-3. In this configuration, the nursing bag 10 has the appearance of a handbag, and may be carried about by a nursing parent as such. The nursing bag 10 is substantially u-shaped. Concave transverse surface 14 has an opening 12, which provides access to interior cavity 16 of the nursing bag 10. As with a typical handbag, items may be placed in the cavity 16 for carrying; in particular, baby-care items, such as diapers, bottles, pacifiers, etc. may be carried within the cavity 16 of nursing bag 10. Zipper 18 may be disposed along the opening 12 to provide a closing mechanism for opening 12. Of course, other closing mechanisms may be used, such as snaps, buttons, clasps or the like.

A strap 20 extends from one end 22 of the concave transverse surface 14 to the opposite end 24 of concave transverse surface 14. The strap 20 may be provided a releasing mechanism 26 so that one end of the strap 20 may be detached from the nursing bag 10. Any suitable releasing mechanism 26 known in the art may be used, such as hooks, buckles, clasps, snaps or the like. Additionally, a cinch 28 may be provided on the strap 20 so that the strap 20 may be lengthened or shortened as desired. Any suitable cinching mechanism 28 may be used, as known in the art. Moreover, it will be appreciated that the cinching mechanism 28 and the releasing mechanism 26 may be the same physical element, as is the case with buckles.

A convex transverse surface 30 defines a side opposite concave transverse surface 14, and provides the bottom for cavity 16 of nursing bag 10. One or more pockets 32 may be disposed along the convex transverse surface 30. Pockets 32 may be sized for a particular type of item, such as a cell phone, a baby bottle, pacifiers, water bottles, sunglasses, etc.

Figure 4:
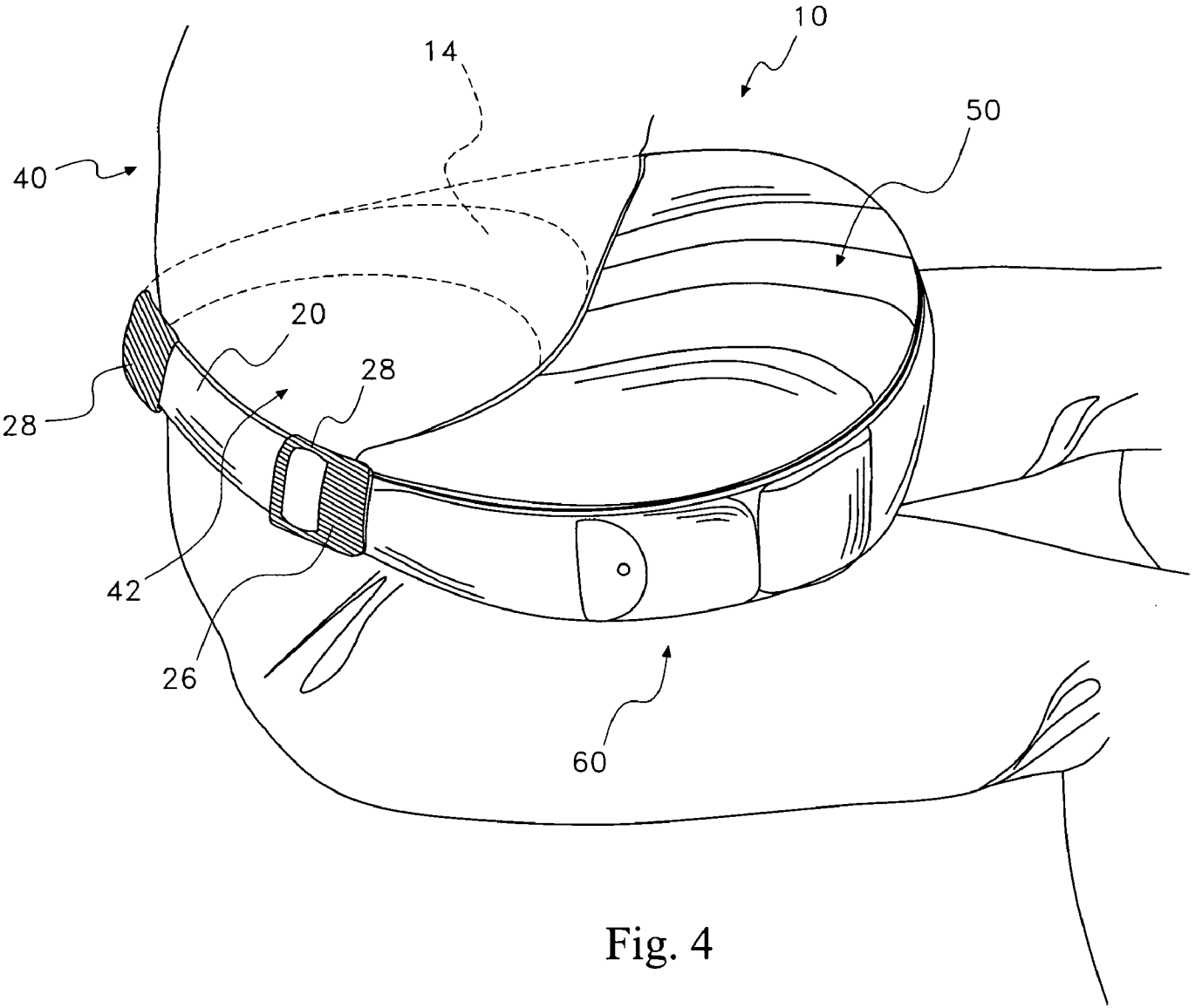
FIG. 4 is a perspective view of the nursing bag depicted in FIG. 1 disposed on the lap of a nursing parent.

As shown in FIG. 4, the concave transverse surface 14 may be pressed up against the torso 42 of a nursing parent 40. As shown, the concave transverse surface 14 provides a snug, conformal fit with the torso 42 of parent 40. In this position, a nursing side 50 of nursing bag 10 faces up, in a relatively horizontal position, while an opposing side 60 rests on the lap of the parent 40. To further secure the nursing bag 10 to parent 40, the strap 20 may be released from the bag 10, by way of releasing mechanism 26, passed around the torso 42 of the parent 40, and then re-attached to the bag 10 by way of the releasing mechanism 26. The cinch 28 may be used to provide a snug fit, loosening or tightening the strap 20 around the torso 42 as required. Hence, the strap 20 and the concave transverse surface 14 together work as an anchoring system that secures the nursing bag 10 resting on the lap of parent 40.

Figure 5:
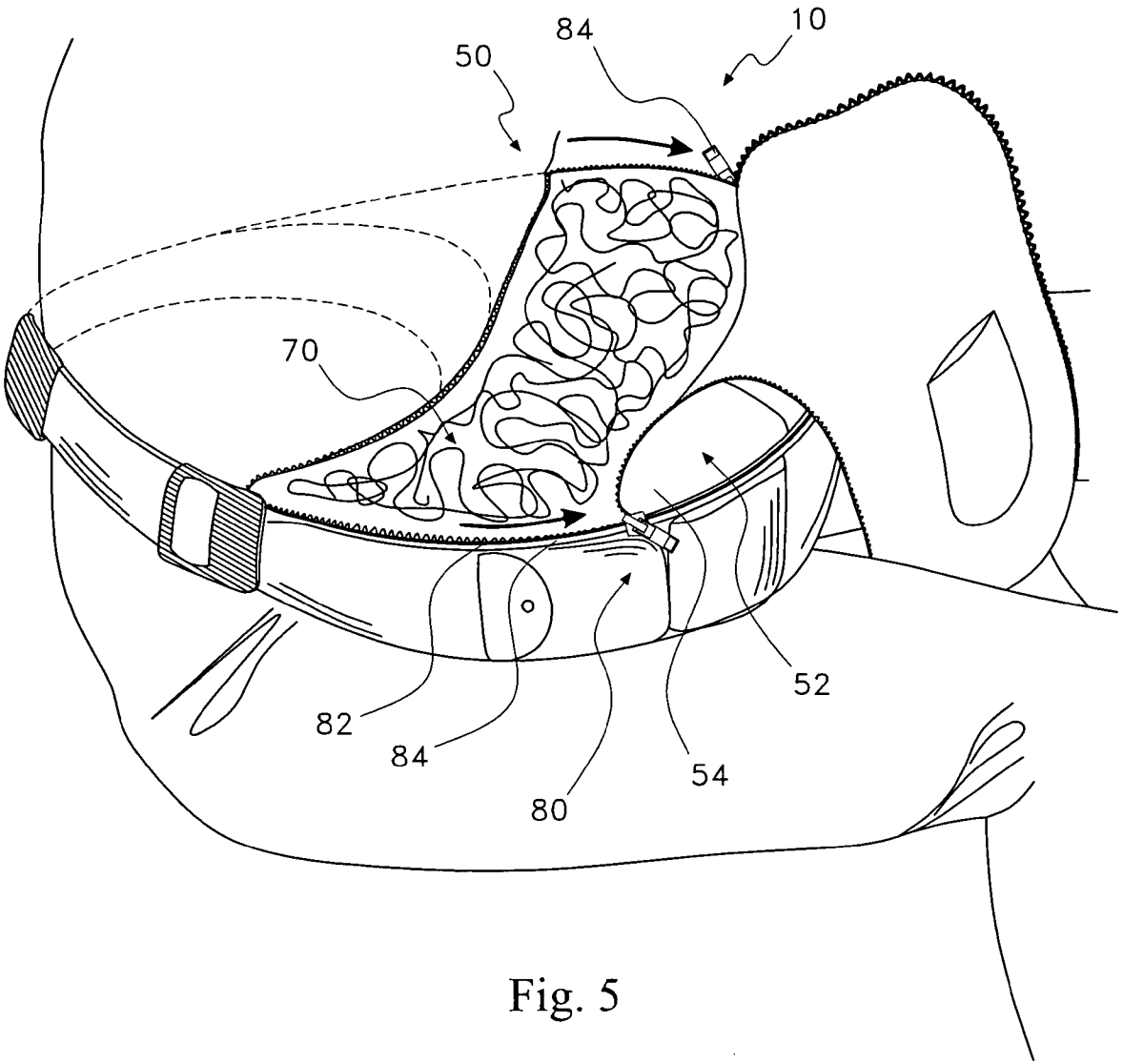
FIG. 5 is a perspective view of the nursing bag depicted in FIG. 1 converting into a second configuration as a nursing pillow.

As shown in FIG. 5, the nursing bag 10 may be converted from the first configuration as a handbag to a second configuration as a nursing pillow. The nursing side 50 of the nursing bag 10 may have a nursing cover 52 that can be removed to expose a nursing platform 70. When closed, the external surface 54 of nursing cover 52 provides the nursing bag 10 with the external appearance of a handbag, while also protecting the nursing platform 70 from dirt and grime. When opened, the nursing cover 52 exposes the nursing platform 70, upon which an infant may be placed, thus converting the nursing bag 10 from a handbag into a nursing pillow. The nursing cover 52, and external surface 54, may be made from any suitable material to achieve the desired visual characteristics of the bag 10, such as leather, nylon, cloth, decorative textile fused to canvas, silk, denier or the like. A zipper 80, running along the outside edge of nursing side 50, may be used to provide a means for opening and closing the nursing cover 52. The zipper 80 may comprise a single chain 82 with two opposing slides 84. In this configuration, the two slides 84 may be unzipped to meet near the bottom center of the bag 10, forming something like a hinge around which the nursing cover 52 may be flexed, while keeping an edge of the nursing cover 52 fixed to the nursing bag 10. Alternatively, two chains 82 may be used, each with a single respective slide 84. In this configuration, the two chains 82 run along the outside edge of the nursing cover 52, but do not connect with each other at the bottom center of the bag 10. Of course, means other than zipper(s) 80 may be used, singly or in combination, to provide removable attachment of the nursing cover 52 to the nursing bag 10; examples include, but are not limited to, buttons, snaps, ties and Velcro®, as known in the art.

Figure 6:
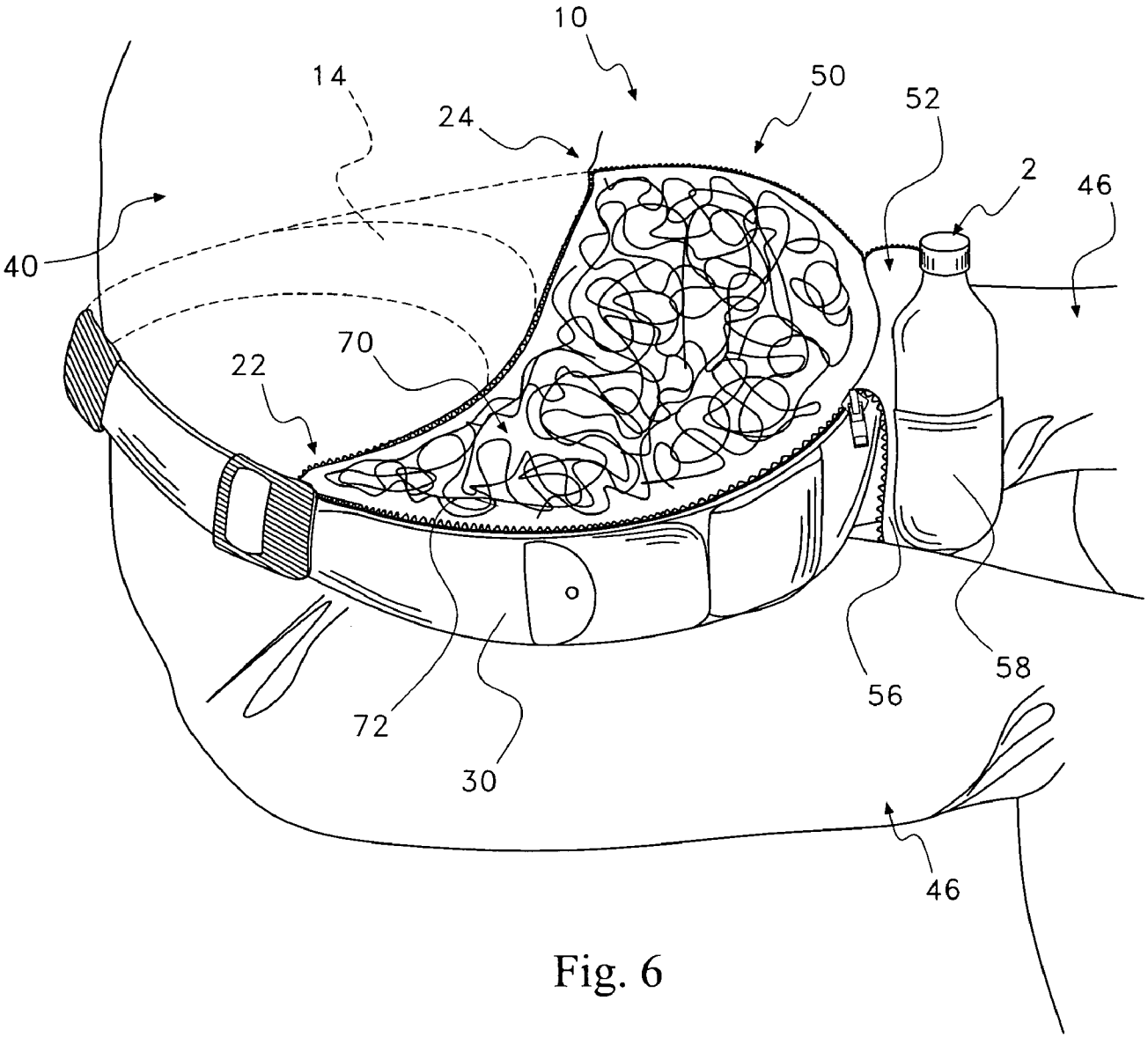
FIG. 6 is another perspective view of the nursing bag depicted in FIG. 1 in a second configuration as a nursing pillow.
Figure 7:
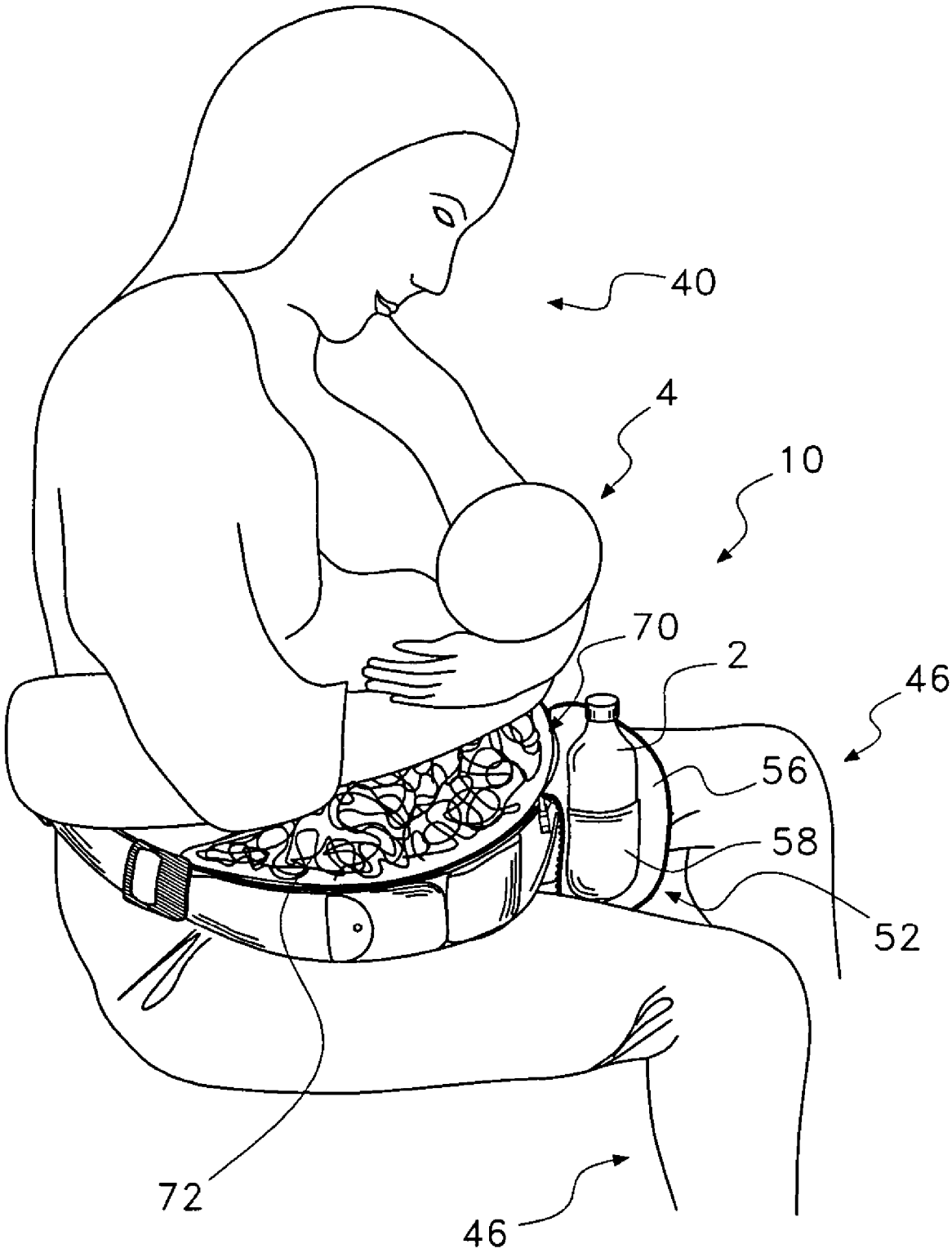
FIG. 7 is a perspective view of the nursing bag depicted in FIG. 6 in use.

As shown in FIGS. 6 and 7, once the nursing bag 10 is fully deployed in its second configuration as a nursing pillow, the nursing bag 10 offers a soft, convenient nursing platform 70, which may be used as a nursing pillow for nursing parent 40. The nursing cover 52 may hang down between the legs 46 of parent 40, and the internal surface 56 of nursing cover 52 may be provided one or more pockets 58. Pockets 58 may be designed to hold, for example, a nursing bottle 2, a cell phone, or any other item that needs to be within handy reach of parent 40 when nursing. Nursing platform 70 provides a soft, clean surface that is suitable to support an infant 4 while nursing, and may be about 16 to about 26 inches wide, as measured from the ends 22, 24 of concave transverse surface 14; i.e., span about 16 to about 26 inches across the lap of nursing parent 40, and thus provide a sufficient amount of surface area to at least support the head, neck, shoulders or torso of infant 4 while nursing. The nursing side 50 may be about tall, as measured within the central region of bag 10 from the concave transverse surface 14 to convex transverse surface 30. The external surface 72 of nursing platform 70 may be made, for example, from fleece, cotton, sheepskin, silk, denier, nylon, quilted fabric, terrycloth or any other suitable material. It may be desirable that the external surface 72 of the nursing platform 70 be made of a hypoallergenic material.

Figure 8:
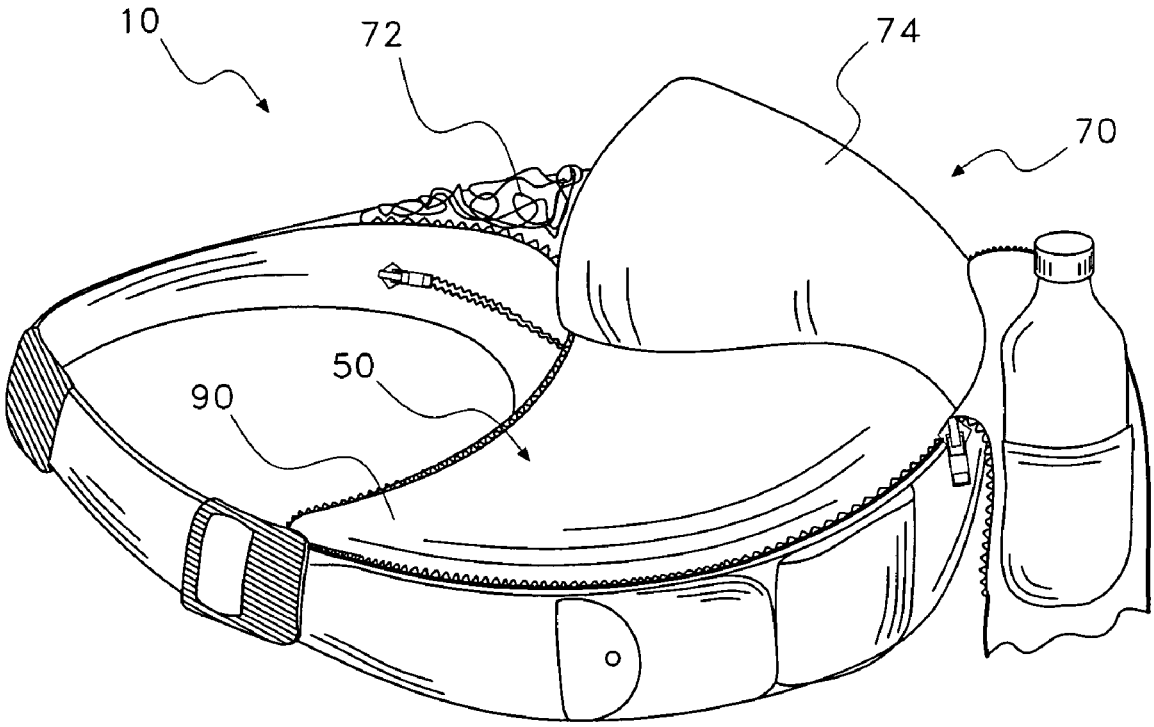
FIG. 8 is a perspective view of the nursing bag in FIG. 1 with a nursing platform being removed.
Figure 9:
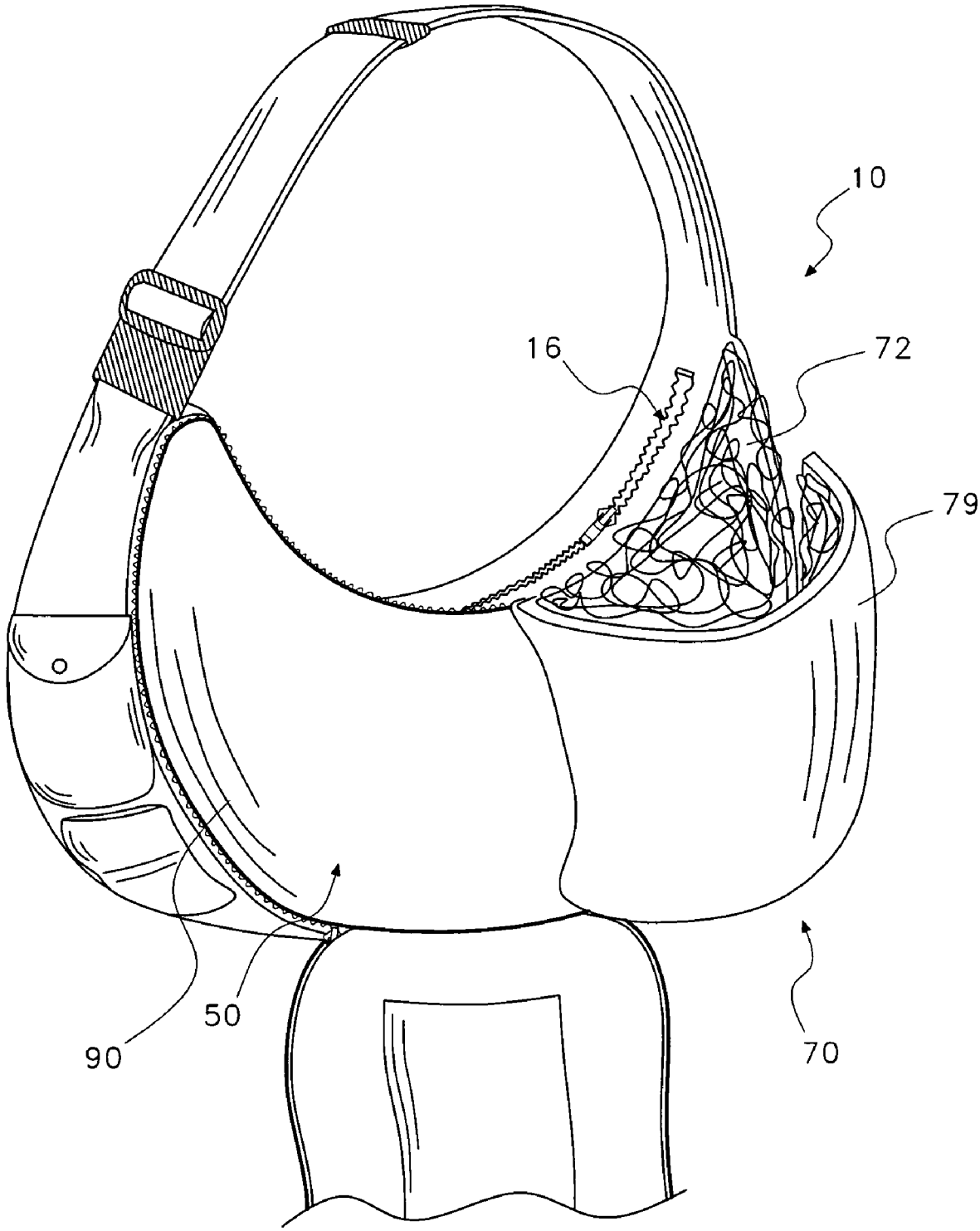
FIG. 9 is another perspective view of the nursing bag depicted in FIG. 8.

As shown in FIGS. 8 and 9, the nursing platform 70 may be removed from the nursing side 50 of bag 10, and thus may be easily cleaned. Although the nursing platform 70 and the external surface 72 are depicted as being aspects of the same removable item, it will be appreciated that the external surface 72 of the nursing platform 70 may be a washable, and optionally decorative, material that covers padding within the nursing platform 70, and which may itself be removed and therefore easily washed. That is, the nursing platform 70 may comprise padding that is covered by a suitable material that provides the external surface 72; the padding may be removed from the nursing bag 10, and the material forming external surface 72 may be removed from the padding for washing. In such a configuration, the padding of the nursing platform 70 may be provided some stiffness so as to buffer an infant from any bumps caused by items within the cavity 16.

The shape of nursing bag 10 may be defined by a u-shaped shell, which is delineated by the surface edges of the nursing bag 10, and which includes the nursing side 50. The nursing side 50 may include an internal wall 90, which can define one of the sidewalls of cavity 16. The internal wall 90 may be made of nylon, leather, cloth, canvas, denier, or any other suitable material. Nursing platform 70 may be removably disposed on the internal wall 90. Any suitable means may be used to connect the nursing platform 70 to the internal wall 90; for example, Velcro® or snaps may be used to removably fix internal surface 74 of nursing platform 70 to the external side of internal wall 90; snaps, however, may be preferable, as the fastening abilities of Velcro® may deteriorate over time and repeated use. Alternatively, a zipper running around the respective outside edges of nursing platform 70 and nursing side 50 may be used. It will be appreciated that if a zipper or similar edge-connection mechanism is utilized, then the unshaped shell need not have the internal wall 90, and instead the sidewall of the cavity 16 may be provided by the internal surface 74 of nursing platform 70.

Figure 10:
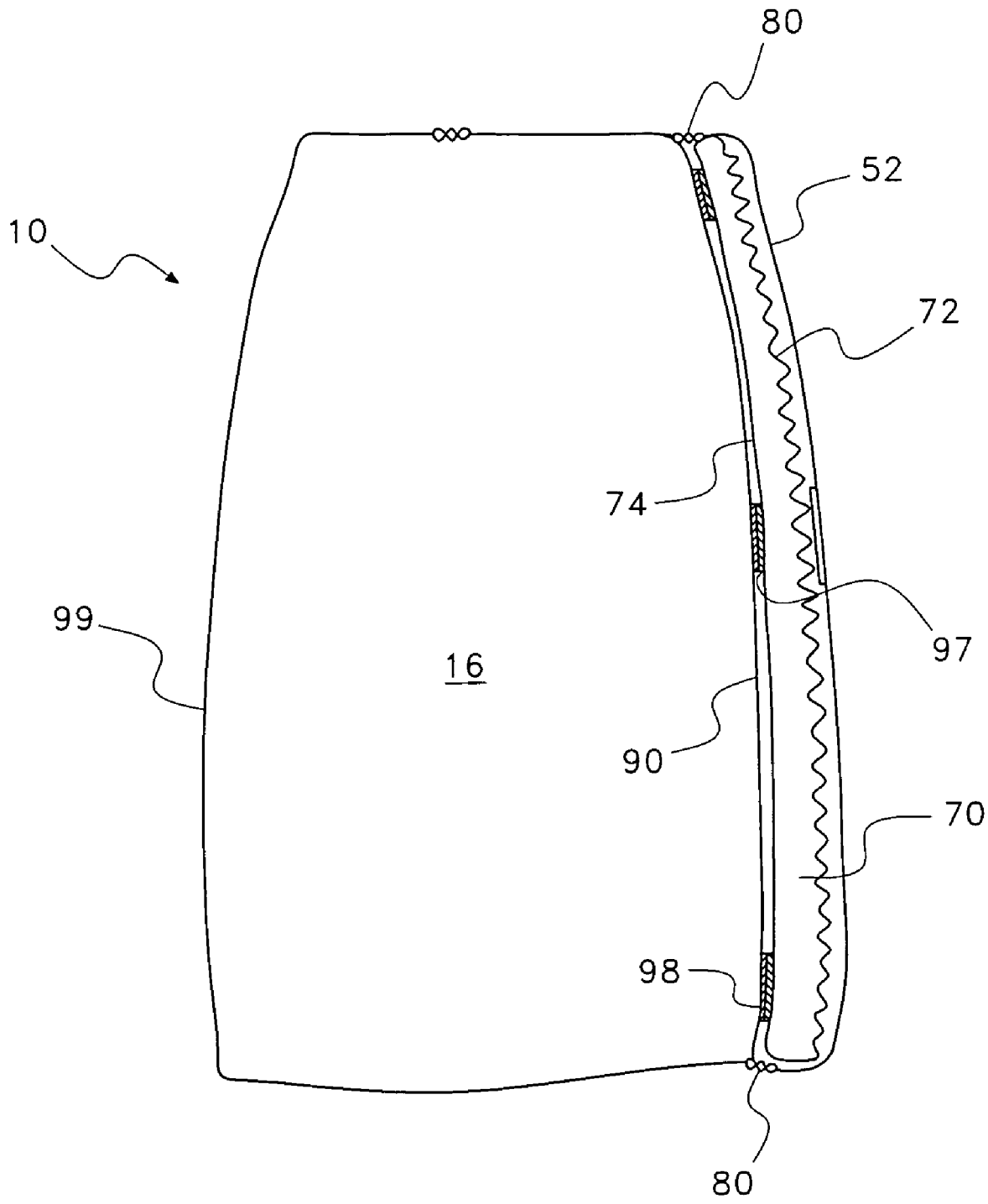
FIG. 10 is a cross-sectional view of the nursing bag depicted in FIG. 1.

FIG. 10 provides a cross-sectional view along line X-X in FIG. 2 of the nursing bag 10. Internal wall 90 may be considered one surface that defines u-shaped shell 99, and which provides a sidewall for cavity 16. Fixed to the external surface of internal wall 90 may be one or more fasteners 98, and fixed to internal surface 74 of nursing platform 70 are corresponding fasteners 97 that removably attach to fasteners 98, so that nursing platform 70 may be attached to, and removed from, the external surface of internal wall 90. Top surface 72 of nursing platform 70 may provide padding that yieldingly supports the nursing infant. It will be appreciated, as discussed above, that additional padding, such as memory foam, cotton batting or the like, may be disposed between bottom surface 74 and internal wall 90 to provide additional yielding support for an infant, or disposed on the internal side of internal wall 90 (i.e., on internal wall 90 within cavity 16). Nursing cover 52 may be zipped up with zippers 80 to cover the nursing platform 70, thereby presenting the appearance of a standard handbag, or unzipped to expose the nursing platform 70.

Figure 11:
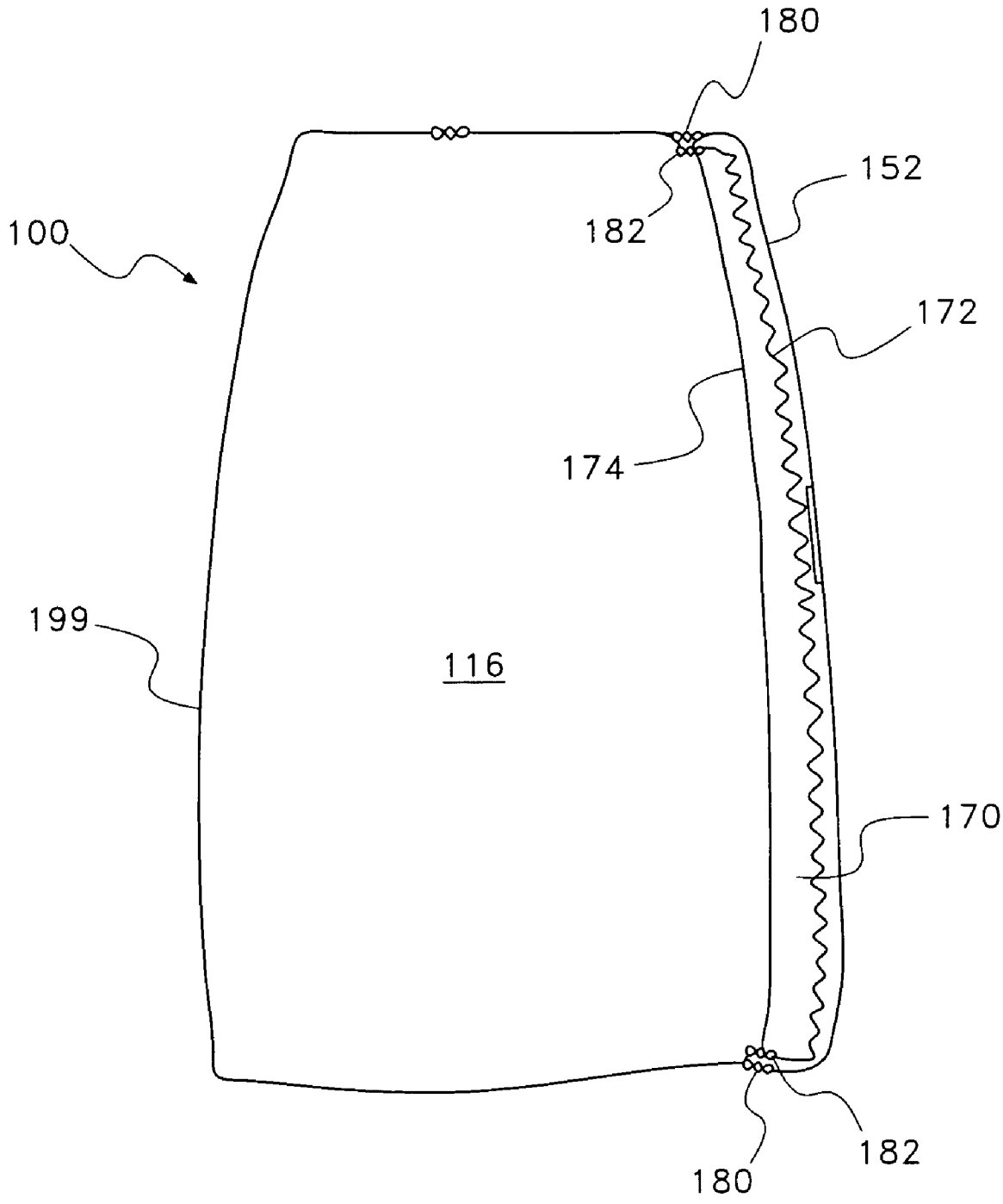
FIG. 11 is a cross-sectional view of a second embodiment nursing bag.

FIG. 11 provides a cross-sectional view of a second embodiment nursing bag 100. The nursing bag 100 is substantially similar to the nursing bag 10, but the nursing side 150 of shell 199, which may be u-shaped, lacks an internal wall. One or more zippers 182 are used to connect nursing platform 170 to the shell 199. Internal surface 174 of nursing platform 170 provides the sidewall for cavity 116 defined by the shell 199. Zippers 180 may be zipped or unzipped to cover or expose the soft support provided by top surface 172 of nursing platform 170. When nursing platform 170 is removed, the sidewall for cavity 116 is provided by nursing cover 152. Of course, additional padding, such as memory foam, may be disposed adjacent to internal surface 174 to provide more yielding support for an infant when placed on top surface 172.

Figure 12:
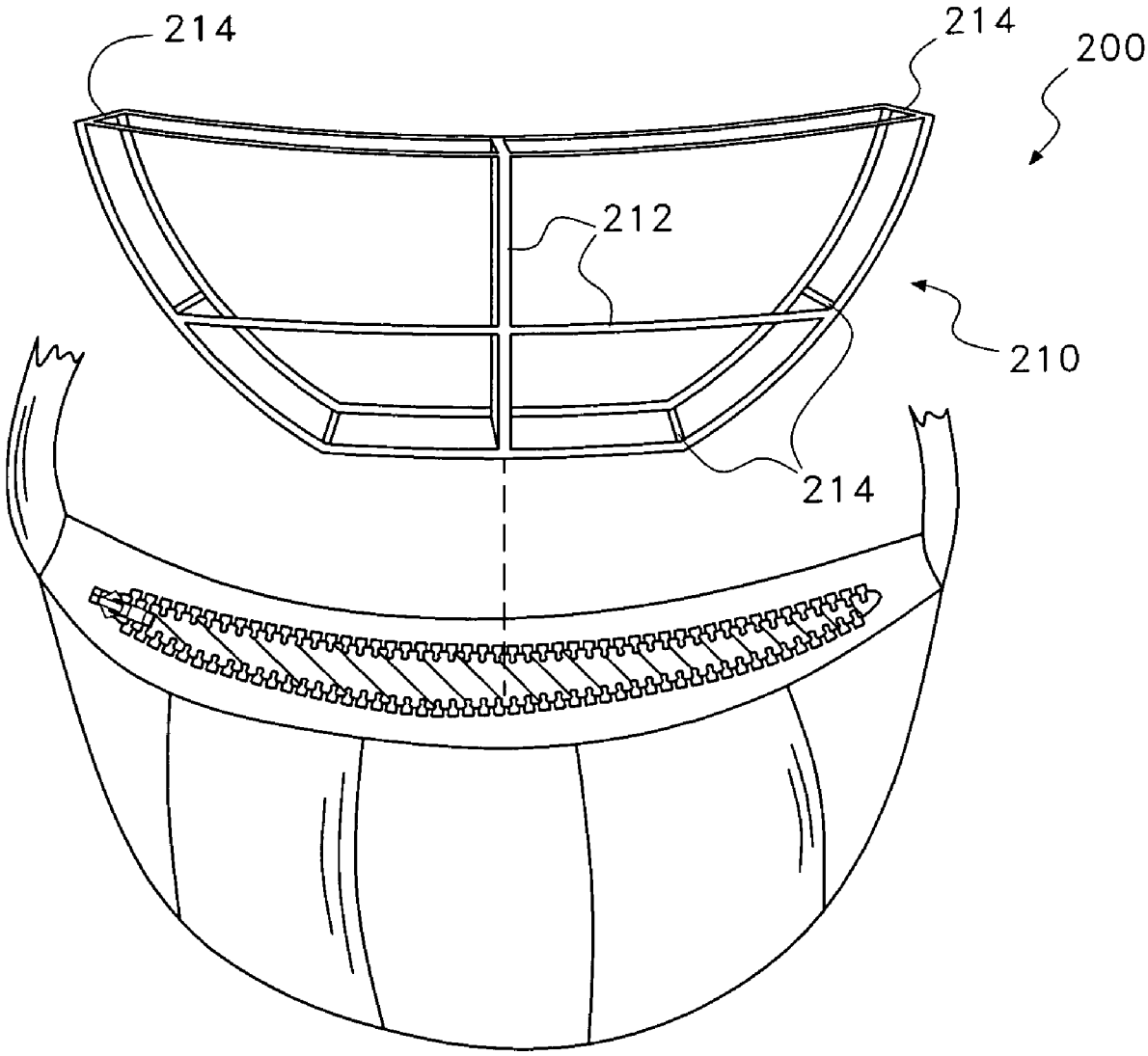
FIG. 12 is an exploded view of a third embodiment nursing bag.
Figure 13:
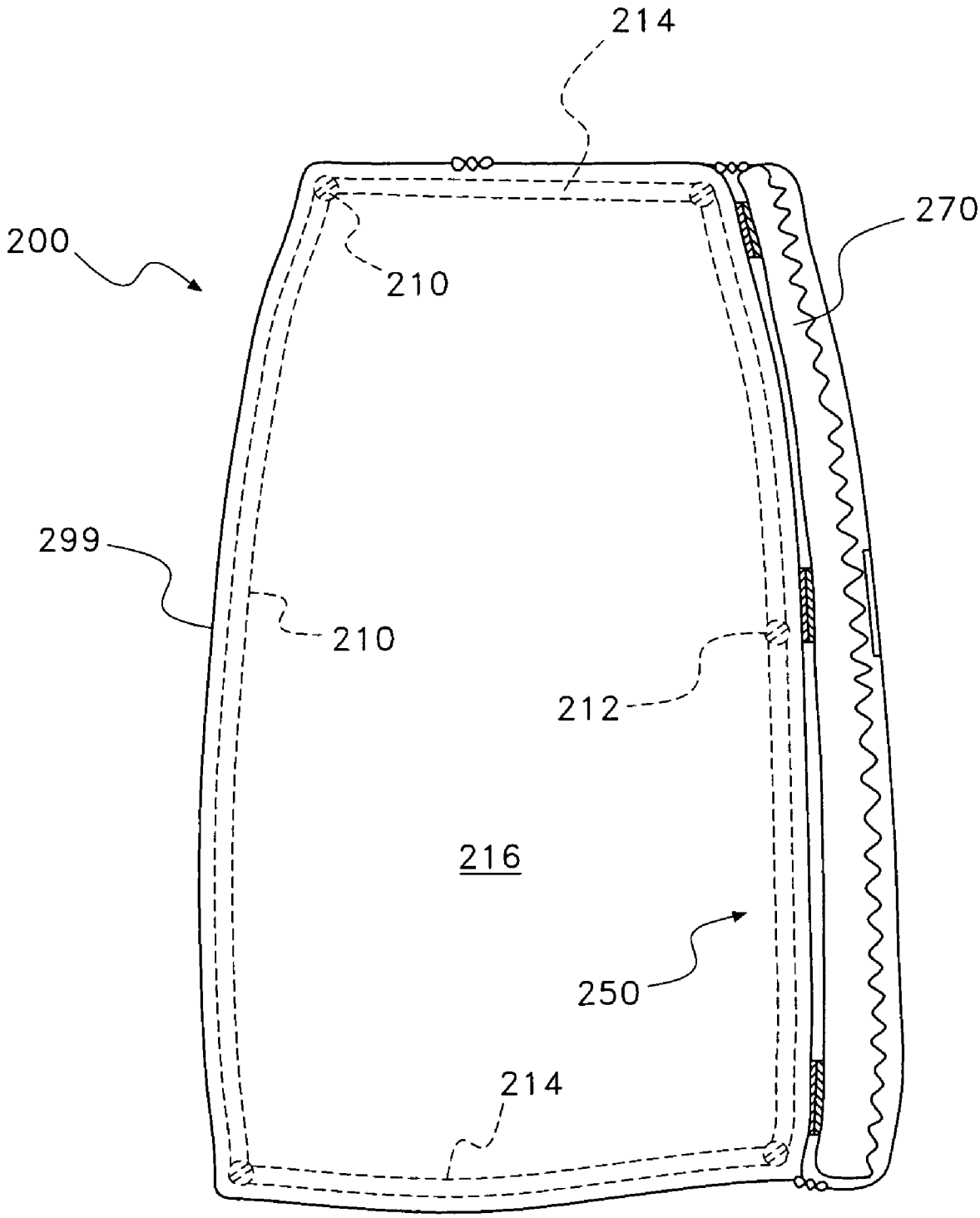
FIG. 13 is a cross-sectional view of the nursing bag depicted in FIG. 12.

FIGS. 12 and 13 illustrate a third embodiment nursing bag 200. To provide additional support to nursing platform 270, a stiffening system 210 may be inserted into the cavity of the nursing bag 200 through opening 216, and may be removed when no longer needed. The stiffening system 210 may include one or more crossbars 212 disposed along the nursing side 250 to provide mechanical support under the nursing platform 270. The stiffening system 210 may also include transverse supports 214 to support the crossbars 212. The stiffening system 210 may be made from any suitable material, such as plastic, metal, cardboard or the like, and should be able to support the weight of an approximately 20 pound nursing infant on the nursing platform 270. The stiffening system 210, along with the padding provided by the nursing platform 270, helps to protect the infant from any hard objects contained within the cavity 216. It will be appreciated that the stiffening system 210 may also be permanently fixed within the cavity of nursing bag 200.

Figure 14:
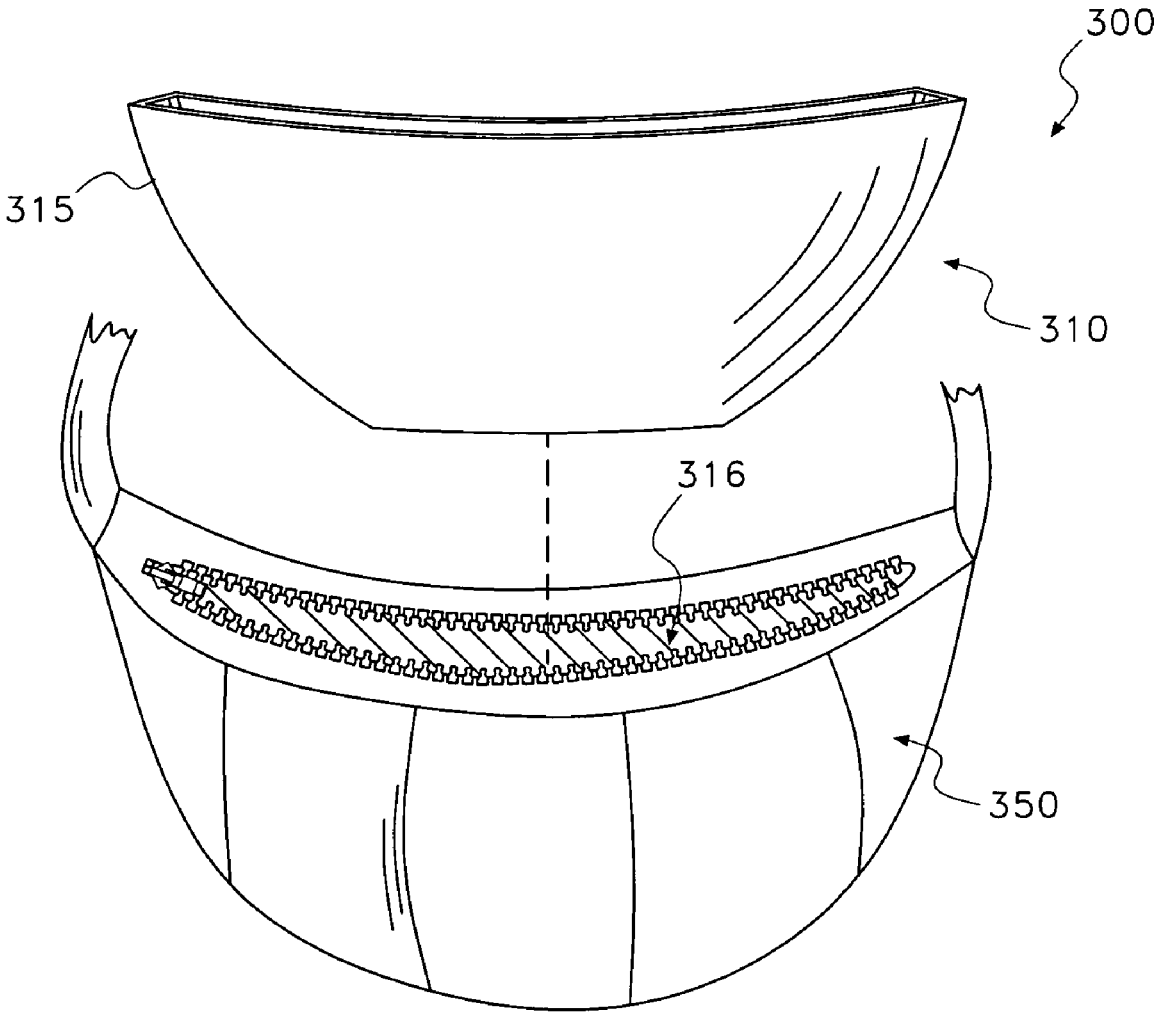
FIG. 14 is an exploded view of a fourth embodiment nursing bag.
Figure 15:
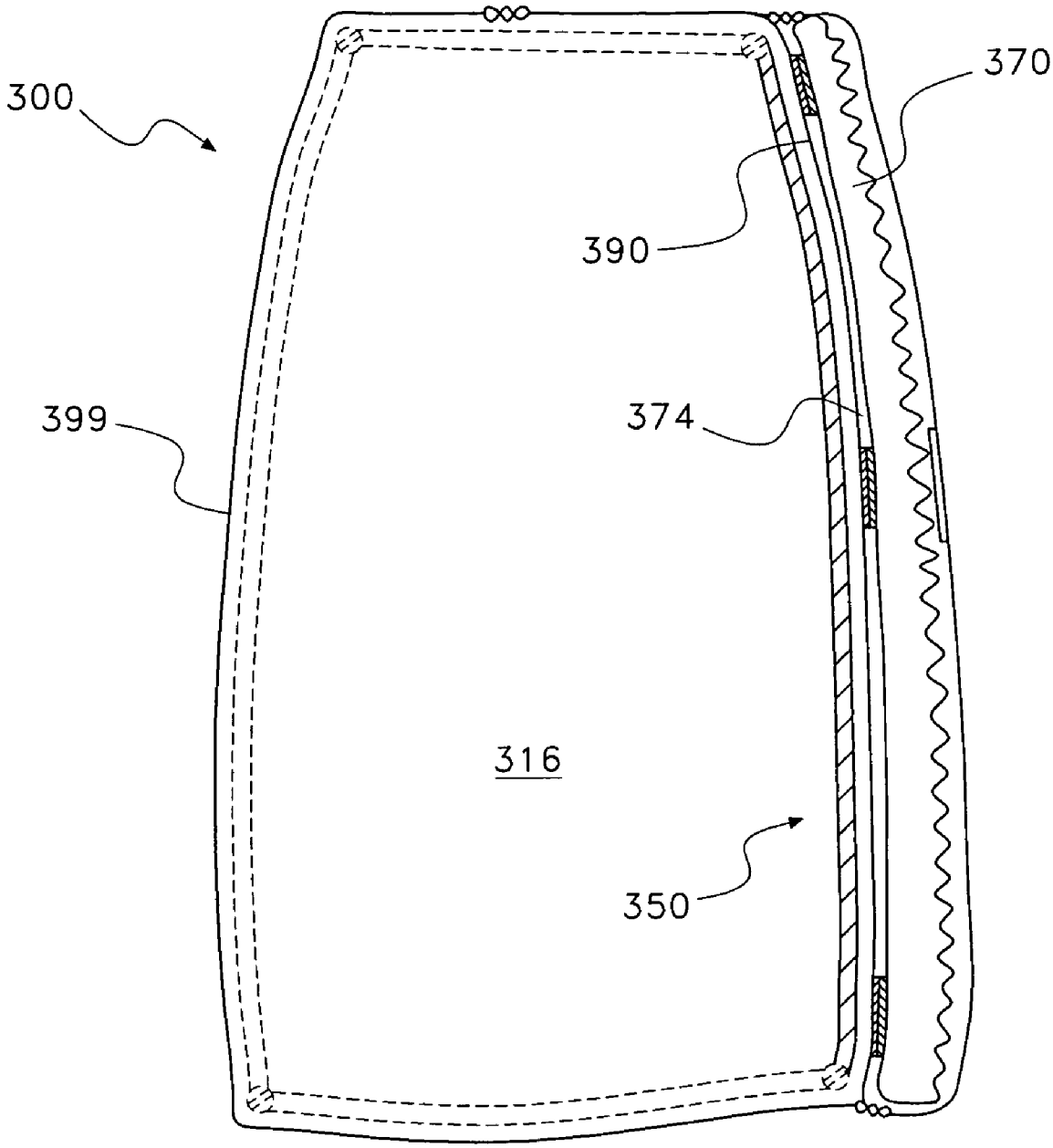
FIG. 15 is a cross-sectional view of the nursing bag depicted in FIG. 14.

It should be clear that many variations to the stiffening system 210 are possible. For example, as shown in FIGS. 14 and 15, rather than providing crossbars, a fourth embodiment nursing bag 300 has a stiffening system 310 that provides a secondary surface 315 disposed adjacent to the nursing side 350 to provide mechanical reinforcement of the nursing platform 370. This secondary surface 315 may be made of plastic, leather or any other suitable material. The secondary surface 315 disposed adjacent to the nursing side 350 helps to protect the infant from any sharp objects disposed within cavity 316, as well as discomfort from hard objects within the cavity 316. Of course, the secondary surface 315 could also be disposed between the bottom surface 374 of the nursing platform 370 and the internal wall 390 of u-shaped shell 399, or be fixed to the bottom surface 374 if nursing side 350 of u-shaped shell 399 has no internal wall 390. Alternatively, the internal wall 390 may be made from a stiff material, such as leather or plastic, to provide the same function as the secondary surface 315.

Figure 16:
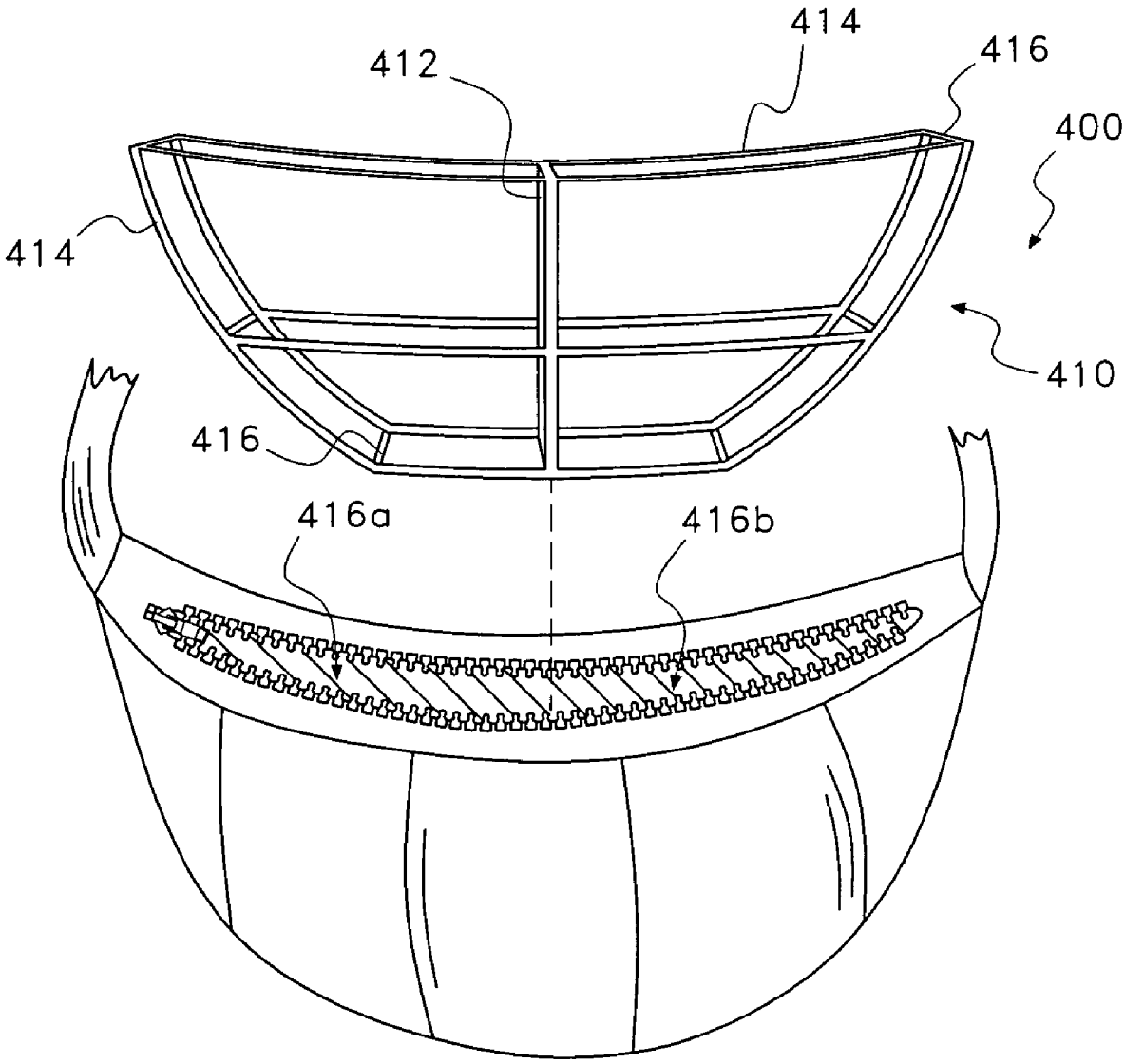
FIG. 16 is an exploded view of a fifth embodiment nursing bag.

The stiffening system may also be used to divide the cavity of the nursing bag into to one or more separate compartments, as exemplified by a fifth embodiment nursing bag 400 shown in FIG. 16. The nursing bag 400 includes a removable stiffening system 410 having a divider 412. The divider 412 may be made from the same material that forms the stiffening system 410, or from a different material. For example, the entire stiffening system 410 could be made from plastic; alternatively, the lateral and vertical supports 414, and the transverse supports 416, could be made of plastic, while the divider 412 is made from cloth or leather. When inserted into the cavity, the divider 412 of the stiffening system 410 divides the cavity into a first compartment **416*a* and a second compartment 416*b*. By providing a plurality of compartments within the cavity, the stiffening system 410 enables a nursing parent to better organize items carried within the cavity, for example by separating baby care products from non-baby care products. Of course, the stiffening system 410 may divide the cavity into more than just two compartments, and many arrangements of dividers 412** are possible.

Figure 17:
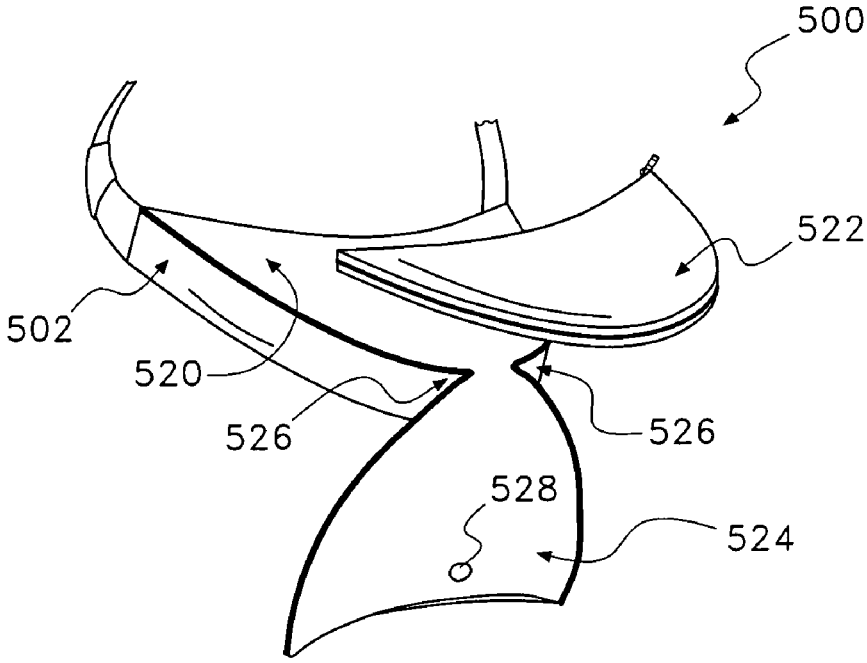
FIG. 17 is an exploded view of a fifth embodiment nursing bag.
Figure 18:
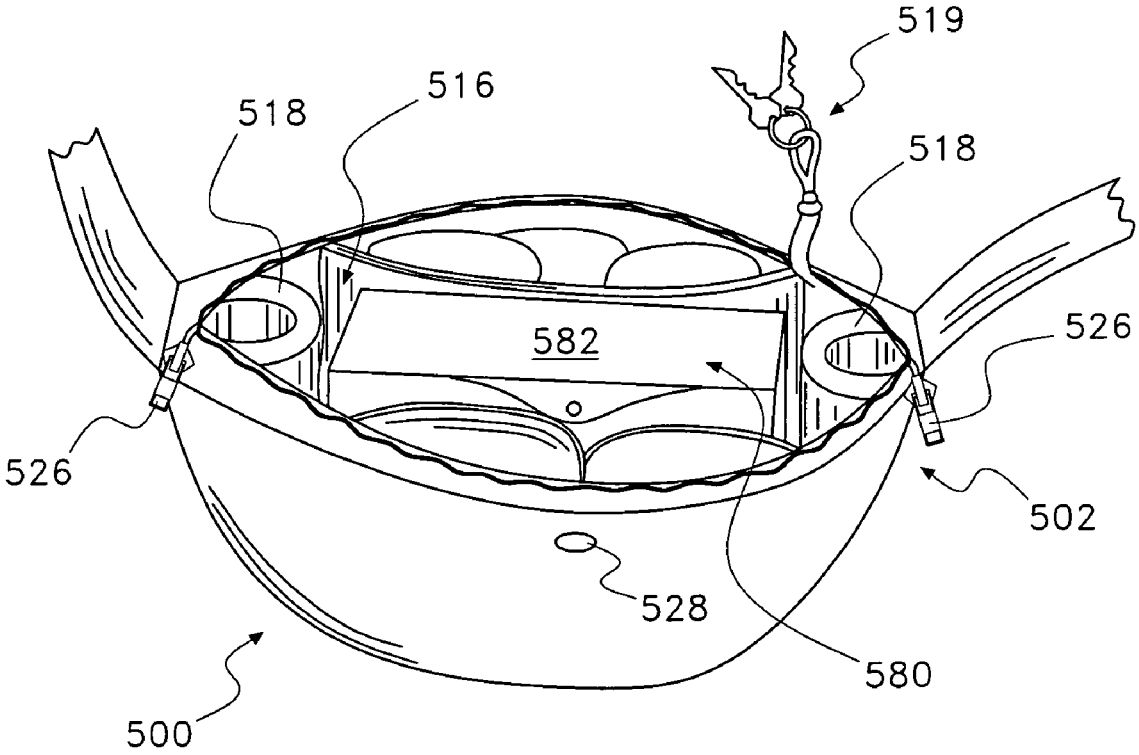
FIG. 18 is a perspective view of the nursing bag depicted in FIG. 17.

For example, as shown in FIGS. 17 and 18, the stiffening system may be a cloth-covered plastic box. A nursing bag 500 has a shell 502, which may be u-shaped, that defines a cavity 516 into which may be inserted a box 580. The box 580 may be plastic, and may optionally be cloth-covered. Padding 522 that provides a nursing platform is removably disposed on nursing side 520, and may be covered and uncovered with nursing cover 524. As shown, two zippers 526 may be used to fasten and unfasten the nursing cover 524 over the nursing side 520, and hence over the padding 522 of the nursing platform. Additionally, a snap 528 may be used to secure a top-central portion of the nursing cover 524 to the nursing side 520. Hence, the nursing cover 524 may also serve as an extra outside pocket for the nursing bag 500 when zipped up.

The box 580 serves as a stiffening system within the cavity 516 to provide structural support for the nursing side 520. Hence, when an infant is placed on the padding 522, the box 580 reinforces the nursing side 520 so that the shell 502 substantially keeps its shape. The box 580 may have a top cover 582 that can be opened and closed to give access to the inside of the box 580. Additionally, the cavity 516 may be provided insulated bottle holders 518, which may also provide structural support to the sides of the nursing side 520, and a clip 519 for holding keys, pacifiers and other small objects that tend to get lost within the cavity 516.

Figure 19:
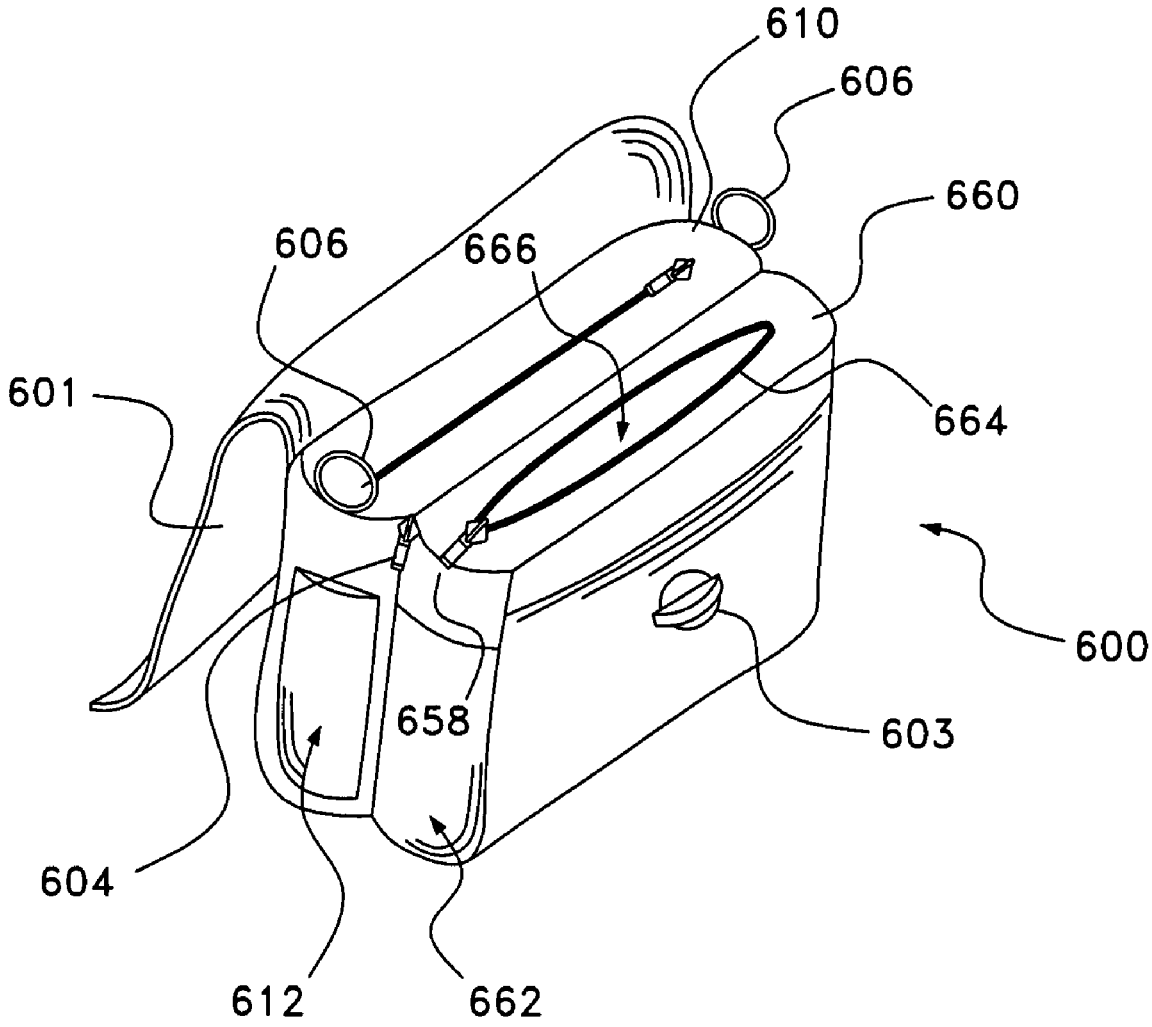
FIG. 19 is a perspective view of a sixth embodiment nursing bag in a first configuration as a handbag.
Figure 20:
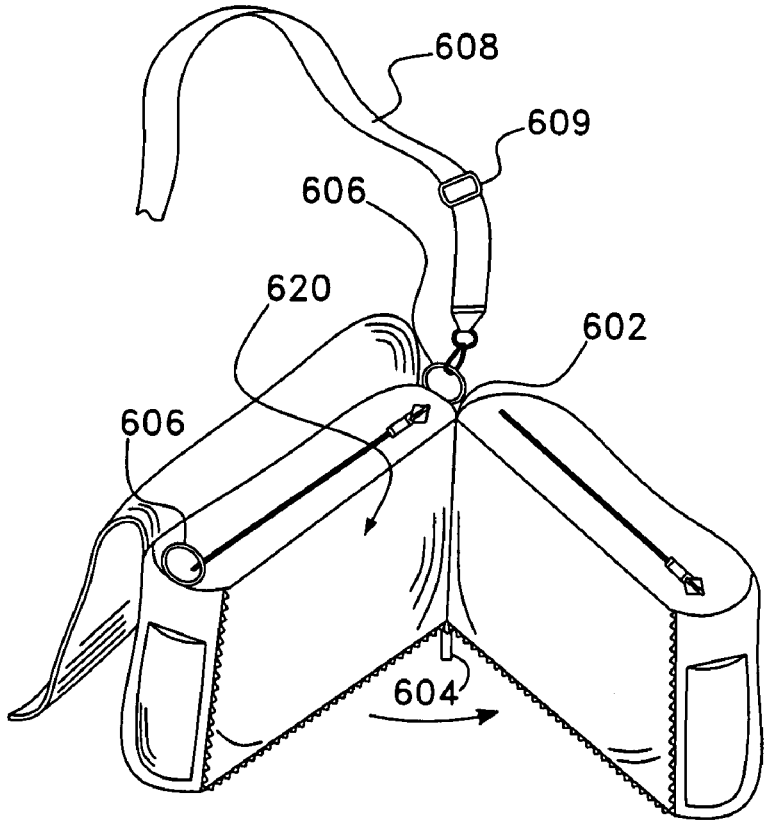
FIG. 20 is a perspective view of the nursing bag depicted in FIG. 19 converting from a first configuration to a second configuration.
Figure 21:
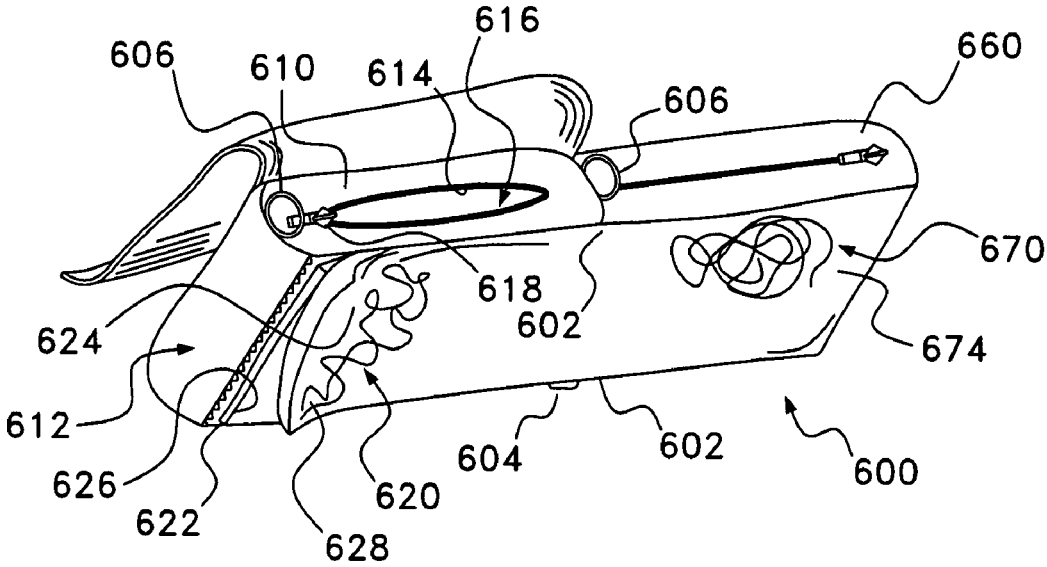
FIG. 21 is a perspective view of the nursing bag depicted in FIG. 19 in a second configuration as a nursing pillow.

The nursing cover is not limited to the relatively simple designs detailed above. The nursing cover may be relatively thick, and may provide a significant amount of the structure of the nursing bag. As shown in FIGS. 19-21, a nursing bag 600 includes a first body 610 and a second body 660. The second body 660 is attached to the first body 610 along a common edge 602. This common edge 602 serves as a pivot, so that the second body 660 folds onto the first body 610. Additionally, a first zipper 604, running along the external edges of the first body 610 and second body 660, may be used to removably attach the first body 610 to the second body 660 so as to prevent the nursing bag 600 from opening unintentionally.

The first body 610 includes a rectangular shell 612, which defines a cavity 616 into which a parent may place baby-care products. The cavity 616 may be accessed via a first opening 614 in the shell 612. This first opening 614 may be sealed or opened in a standard manner, as with clasps, buttons, a second zipper 618 or the like. The first body 610 has a nursing side 620, onto which is removably disposed padding 622. Any connection method may be used to attach the padding 622 to the nursing side 620, such as Velcro®, snaps, one or more zippers, or the like. As shown, the padding 622 may include interior padding 626 surrounded by, or covered by, exterior covering 628. The exterior covering 628 may be easily removed from the interior padding 626 for washing, much like a pillowcase, a cover slip or the like.

In a similar manner, the second body 660 may include a rectangular shell 662, the shape of which may correspond to the first body 610 so that, when folded together, the first body 610 and second body 660 provide the nursing bag 600 with a consistent, and aesthetically pleasing shape. The shell 662 may also define a cavity 666 into which may be placed baby-care products or the like. The cavity 666 may be accessed via a second opening 664 in the shell 662, which may also be sealed or opened with clasps, buttons, a zipper 668 or the like. The second body 660 has a nursing side 670, onto which the padding 622 is also removably disposed. Of course, it will be understood that each nursing side 620, 670 could have its own, individual set of padding, but the embodiment 600 elects to use a single padding set 622 to cover both nursing sides 620, 670.

The nursing side 620 with the padding 622 provides a first nursing platform 624 that provides soft, yielding support for an infant. Similarly, the nursing side 670 with the padding 622 provides a second nursing platform 674. Hence, when the nursing bag 600 is unfolded, the first nursing platform 624 and the second nursing platform 674 combine to provide a soft, wide nursing surface suitable for an infant. It will be appreciated that the second body 660 thus acts as a nursing cover for the first nursing platform 624; when folded atop the first nursing platform 624, the second body 660 covers and protects the padding 622 from dirt and exposure, and also provides an aesthetically pleasing external appearance for the nursing bag 600. Similarly, the first body 620 serves as a nursing cover for the second nursing platform 670, removably covering the padding 622 on the second nursing side 670.

As with the previous embodiments, the nursing bag 600 supports two distinct configurations. In a first configuration as a handbag, the first body 610 and second body 660 are folded together, serving as respective nursing covers for the padding 622, and providing an external appearance of a standard handbag. In this configuration, the first zipper 604 is zipped up to secure the second body 660 to the first body 610. A strap 608, used for carrying the nursing bag 600, may be releasably attached to eyelets 606, in a standard manner. The strap 608 may include a cinch 609 to adjust the length of the strap 608. A top cover 601 may be provided to cover the first opening 614 and second opening 664, and may be secured by a snap 603 or similar mechanism. In one embodiment, when folded the nursing bag 600 may be about 7 inches wide, 13 inches long and 12 inches high.

The first zipper 604 may then be unzipped, and the second body 660 opened away from the first body 610 to convert the nursing bag 600 into a second configuration as a nursing pillow. In this configuration, the first nursing side 620 is relatively coplanar with the second nursing side 670, exposing the padding 622 to provide a wide, soft and clean nursing platform. Suitable tensile support extending across the first nursing side 620 and second nursing side 670, and the relative thickness of the first body 610 abutting against the second body 670, can prevent over-extension of the first body 610 with respect to the second body 660 so that the entire nursing platform remains relatively flat. The strap 608 may be secured around the waist of the parent to anchor the nursing bag 600.

The above-described exemplary embodiments are intended to be illustrative in all respects, rather than restrictive, of the present invention. Thus the present invention is capable of many variations in detailed implementation that can be derived from the description contained herein by a person skilled in the art. All such variations and modifications are considered to be within the scope and spirit of the present invention as defined by the following claims.

What is claimed is:

1. A nursing bag comprising:

a shell defining a cavity and having a nursing side;

an opening in the shell;

a closing mechanism adapted to close the opening;

a nursing platform disposed on the nursing side externally to the cavity, the nursing platform adapted to provide yielding support for an infant; and a stiffening system where at least a portion of the stiffening system is disposed between the nursing platform and the cavity;

wherein the shell, or the shell in combination with the nursing platform define a front wall, a back wall, and transverse walls connecting the front and the back walls of the cavity, wherein the cavity is adapted to serve as a bag for carrying products and is closable with the closing mechanism; and wherein the shell further comprises a concave transverse surface with an opening for providing access to the cavity, and an opposing convex transverse surface providing a bottom for the cavity.

2. The nursing bag of claim 1 wherein the nursing platform is removably disposed on the nursing side.

3. The nursing bag of claim 2 wherein the nursing platform comprises an external surface removably disposed around padding.

4. The nursing bag of claim 1 further comprising a nursing cover removably disposed over the nursing platform.

5. The nursing bag of claim 4 wherein the nursing cover is foldably attached to the shell.

6. The nursing bag of claim 4 wherein an internal surface of the nursing cover comprises a pocket.

7. The nursing bag of claim 1 further comprising a strap coupled to ends of the transverse surface, the strap comprising a detachable end and a cinch for lengthening or shortening the length of the strap.

8. The nursing bag of claim 1 wherein the bag for carrying baby care products is selected from the set consisting of a handbag, a shoulder bag and a diaper bag.

9. The nursing bag of claim 1 wherein the stiffening means is removably disposed within the cavity.

10. The nursing bag of claim 1 wherein the stiffening means divides the cavity into a plurality of compartments.

11. The handbag of claim 1, wherein the stiffening system is removably inserted inside the cavity defined by the shell, and wherein the stiffening system defines another cavity and is adapted to provide reinforcement for the nursing platform.

12. The handbag of claim 11, wherein the stiffening system comprises one or more crossbars disposed along the nursing side and transverse supports to support the crossbars.

13. The handbag of claim 12, wherein the stiffening system comprises a front, back, side, and bottom walls, wherein the front wall defines a secondary surface disposed adjacent to the nursing platform.

14. A nursing bag comprising:

a first shell defining a first cavity having a first nursing side;

an opening in the shell;

a closing mechanism adapted to close the opening;

a first nursing platform disposed on the first nursing side externally to the first cavity, the first nursing platform adapted to provide yielding support for an infant; and a nursing cover attached to the shell and capable of being foldably disposed over the first nursing platform for protecting the first nursing platform, and wherein the shell, or the shell in combination with the nursing platform define a front wall, a back wall, and transverse walls connecting the front and the back walls of the cavity, wherein the cavity is adapted to serve as a bag for carrying products and is closable with the closing mechanism, wherein the first shell further comprises a concave transverse surface with an opening for providing access to the first cavity, and an opposing convex transverse surface providing a bottom for the first cavity.

15. The nursing bag of claim 14 further comprising a strap coupled to ends of the concave transverse surface, the strap having a detachable end and a cinch for lengthening or shortening the length of the strap.

16. The nursing bag of claim 14 further comprising a stiffening means removably disposed within the first cavity for providing rigid support between the first cavity and the first nursing platform.

17. The nursing bag of claim 16 wherein the stiffening means divides the first cavity into a plurality of compartments.

18. The nursing bag of claim 14 wherein the nursing cover further comprises a second nursing side, and a second nursing platform is disposed on the second nursing side.

19. The nursing bag of claim 18 wherein the nursing cover is flexibly attached to the first shell so that the first nursing platform is foldable onto the second nursing platform.

20. The nursing bag of claim 19 wherein the nursing cover comprises a second shell that defines a second cavity; wherein the second shell folded onto the first shell together serve as a handbag, a shoulder bag or a diaper bag.

21. The nursing bag of claim 14 wherein the first nursing platform is removably disposed on the first nursing side.

22. The nursing bag of claim 14 wherein an internal surface of the nursing cover comprises a pocket.

23. A nursing bag comprising:

a substantially u-shaped shell defining a cavity and having a concave traverse side, a convex side opposite the concave traverse side, a nursing side, and a back wall;

an opening in the shell and a closing mechanism disposed along the opening and adapted to close the opening;

a strap having an adjustable length and detachably attached to the shell at the opposite ends of the concave side wherein the strap and the concave transverse surface work together to secure the bag to an individual;

a nursing platform disposed on the nursing side externally to the cavity, the nursing platform adapted to provide yielding support for an infant;

a stiffening system where at least a portion of the stiffening system is disposed between the nursing platform and the cavity;

a nursing cover attached to the shell and capable of being foldably disposed over the nursing platform for protecting the nursing platform, and wherein the shell, or the shell in combination with the nursing platform define a front wall, a back wall, and transverse walls connecting the front and the back walls of the cavity, wherein the cavity is adapted to serve as a bag for carrying products and is closable with the closing mechanism.

* * * * *